US007394435B1

(12) United States Patent
Tavassoli Hozouri

(10) Patent No.: US 7,394,435 B1
(45) Date of Patent: Jul. 1, 2008

(54) SLOT ANTENNA

(75) Inventor: Behzad Tavassoli Hozouri, Santa Clara, CA (US)

(73) Assignee: Wide Sky Technology, Inc., Hong Kong (CN)

( * ) Notice: Subject to any disclaimer, the term of this patent is extended or adjusted under 35 U.S.C. 154(b) by 94 days.

(21) Appl. No.: 11/608,371

(22) Filed: Dec. 8, 2006

(51) Int. Cl.
*H01Q 13/10* (2006.01)

(52) U.S. Cl. ..... 343/770; 343/767; 343/893; 343/895; 343/898

(58) Field of Classification Search ..... 343/770, 343/767
See application file for complete search history.

(56) References Cited

U.S. PATENT DOCUMENTS 4,185,289 A 1/1980 DeSantis et al.
4,242,685 A 12/1980 Sanford
4,297,707 A 10/1981 Brunner et al.
4,916,457 A 4/1990 Foy et al.
5,202,697 A * 4/1993 Bonebright et al. ..... 343/770
5,581,266 A 12/1996 Peng et al.
5,955,997 A 9/1999 Ho et al.
6,088,000 A 7/2000 Ho
6,127,983 A * 10/2000 Rivera et al. ..... 343/767
6,157,346 A * 12/2000 Ho ..... 343/770
6,288,686 B1 9/2001 Josypenko
6,300,917 B1 10/2001 Leisten et al.
6,304,226 B1 10/2001 Brown et al.
6,369,776 B1 4/2002 Leisten et al.
6,414,647 B1 * 7/2002 Lee ..... 343/793
6,424,316 B1 7/2002 Leisten
6,445,354 B1 9/2002 Kunysz
6,552,693 B1 4/2003 Leisten
6,642,898 B2 11/2003 Eason
6,646,618 B2 11/2003 Sievenpiper
6,690,336 B1 2/2004 Leisten et al.
6,703,984 B2 * 3/2004 Schadler ..... 343/770
6,791,497 B2 9/2004 Winebrand et al.
6,911,952 B2 6/2005 Sievenpiper et al.
6,914,580 B2 7/2005 Leisten (Continued)

OTHER PUBLICATIONS

Ho et al., A Novel Crank Quadrifiler Slot Antenna For GPS Handheld Receivers, 1998 IEEE-APS Conference on Antennas and Propagation for Wireless Communications, Nov. 1-4, 1998, pp. 133-136.

(Continued)

*Primary Examiner*—Trinh V Dinh
(74) *Attorney, Agent, or Firm*—Raymond E. Roberts; Patent Venture Group

(57) ABSTRACT

An antenna (10) having outer and inner sections (12, 14) of electrically conductive material and coaxial with a longitudinal axis (19). The outer section includes an outer side wall (22) extending from the bottom to join an outer top wall at the top of the antenna. The inner section includes an inner side wall extending upward from the bottom to join an inner top wall. The outer and inner sections define an interior region (32) filled with dielectric material. The outer section has at least one slotted opening (34) with opposed ends, wherein each such slotted opening extends from one end in the outer side wall, across the outer top wall, and to the opposed end in the outer side wall. The inner section including at least one feed (36) to convey electromagnetic energy into or out of said interior region of the antenna.

14 Claims, 6 Drawing Sheets

U.S. PATENT DOCUMENTS

| | | | |
|---|---|---|---|
| 2005/0104793 | A1 | 5/2005 | Yuanzhu |
| 2006/0038739 | A1 | 2/2006 | Feng et al. |
| 2006/0071874 | A1 | 4/2006 | Wither et al. |

OTHER PUBLICATIONS

Sarrio et al, Full-wave Analysis Of Sleeve Balun On Coaxial Cables, Electronic Letters, vol. 38, No. 7, Mar. 28, 2002, pp. 304-305.

Sievenpiper et al., Low-profile Cavity-backed Crossed-slot Antenna With A Single-probe Feed Designated For 2.34 GHz Satellite Radio Applications, IEEE Transactions On Antennas And Propagation, vol. 52, No. 3, Mar. 3, 2004, pp. 873-879.

Qin et al., Broadband High-efficiency Circularly Polarized Active Antenna And Array For RF Front-end Application, IEEE Transactions On Microwave Theory And Techniques, vol. 54, No. 7, Jul. 2006, pp. 2910-2916.

* cited by examiner

SLOT ANTENNA

TECHNICAL FIELD

The present invention relates generally to communications and radio wave antennas, and more particularly to slot type antennas.

BACKGROUND ART

In numerous communication networks today it is required to establish communications between stations where at least one is mobile. Important requirements for antennas in such applications typically include having very wide beam coverage (ideally an omnidirectional pattern), compact structure, specific polarization type, and enough efficiency over a specific bandwidth. Cellular telephone handsets and global positional system (GPS) equipment are two common examples of devices which impose such requirements. In fact, the latter usually needs an antenna with relatively more strict conditions, i.e., right-hand circular polarization and a very wide beam coverage pattern encompassing nearly the entire upper hemisphere. This is needed to allow a GPS receiver to maintain signal lock with and to track as many visible satellites as possible while also providing useful signal-to-noise and front-to-back ratios (that is, the radiation pattern has a substantially lower gain in the direction opposite to the direction of maximum gain).

One widely used option today for such applications is the patch antenna. However, these can require tradeoffs that are undesirable or unacceptable, especially in small or mobile applications. Generally, a patch antenna has a usefully low profile but this may be offset by the need for a large ground plane. A patch antenna therefore often cannot provide satisfactory performance where space is very limited. Patch antennas also do not provide good circular polarization over a very wide angular region and they tend to have poor gain at low angles of elevation, thus making them a poor choice for GPS applications. And patch antennas also do not provide a good front-to-back ratio.

Another candidate is the quadrifilar helical antenna (QFH), particularly in printed forms. Some of the advantages of the QFH antenna are its relatively compact size (compared to other known useable antennas such as crossed dipoles), its relatively small diameter, good quality of circular polarization (suitable for satellite communication), and its having a cardioid pattern, i.e., a main forward lobe which extends over a generally hemispherical region together with a good front-to-back ratio. The size of QFH antennas can also be reduced by dielectric loading or by shaping the printed linear elements. Unfortunately, QFH antennas require radiator lengths that are an integer multiple of one-quarter wavelength of the desired resonant frequency. Particularly for portable or mobile applications, this may require substantial miniaturization efforts to avoid having an overall antenna length that is longer than desired. The complexity of the feed system to obtain desired performance is often also an issue with QFH antennas.

Another prior art antenna is the slot type antenna. Slot antennas typically have a planar structure (sometimes somewhat curved) that includes at least one slot, and they are usually fed with microstrip lines or a coaxial feeder in the antenna cavity resonator. Although the performance of slot antennas is less dependent on the presence of a ground plane, the available slot antennas today have nearly all of the other shortcomings of patch antennas noted above. For example, the relatively large size required of the usual crossed slot antenna structure needed to create circular polarization is usually undesirable. Cylindrical slot antennas have been designed to address some of these issues, but these have not been able to provide very wide beam coverage and tend to be relatively long. No simple feed system for these has been reported either.

DISCLOSURE OF INVENTION

Accordingly, it is an object of the present invention to provide improved slot type communication antennas.

Briefly, one preferred embodiment of the present invention is an antenna having a top, a bottom, and a central lengthwise axis. An outer section of electrically conductive material is provided which is coaxial with the lengthwise axis. This outer section includes an outer side wall, extending from the bottom to join an outer top wall at the top of the antenna. An inner section of electrically conductive material is also provided, which is also coaxial with the axis. This inner section includes an inner side wall extending from the bottom to join an inner top wall. The outer section and the said inner section collectively define an interior region that is filled with dielectric material. The outer section has at least one slotted opening with opposed slot ends. Each such slotted opening extends from one opposed slot end in the outer side wall, across the outer top wall, and to the other opposed slot end in the outer side wall. And the inner section including at least one feed to convey electromagnetic energy into or out of the interior region of the antenna.

An advantage of the present invention is that it provides an antenna that is particularly suitable for mobile and handheld applications.

Another advantage of the invention is that it provides an antenna that can have a compact structure, and an antenna that can tradeoff between various dimensions to optimize that structure.

Another advantage of the invention is that it provides an antenna that is efficient at the frequencies of many important and emerging applications, and an antenna that is efficient across the bandwidths needed for such applications.

Another advantage of the invention is that it provides an antenna that can have suitable signal-to-noise and front-to-back ratios for many applications.

Another advantage of the invention is that it provides an antenna that can have wide beam coverage providing near-hemispherical radiation coverage approaching an omnidirectional pattern.

Another advantage of the invention is that it provides an antenna that can employ a variety of feed systems, ranging from simple feed systems to complex feed networks, needed for desired features (e.g., antenna polarization) and as applications require.

Another advantage of the invention is that it provides an antenna that can have linear or circular polarization over a wide angular range (e.g., right-hand circular polarization, beam width up to about 160 degrees, and with a suitable front-to-back ratio all as typically required for GPS applications).

And another advantage of the invention is that it provides an antenna suitable for mass production and low cost production.

These and other objects and advantages of the present invention will become clear to those skilled in the art in view of the description of the best presently known mode of carrying out the invention and the industrial applicability of the preferred embodiment as described herein and as illustrated in the figures of the drawings.

BRIEF DESCRIPTION OF THE DRAWINGS

The purposes and advantages of the present invention will be apparent from the following detailed description in conjunction with the appended figures of drawings in which.

In the various figures of the drawings, like references are used to denote like or similar elements or steps.

BEST MODE FOR CARRYING OUT THE INVENTION

Figure 1:
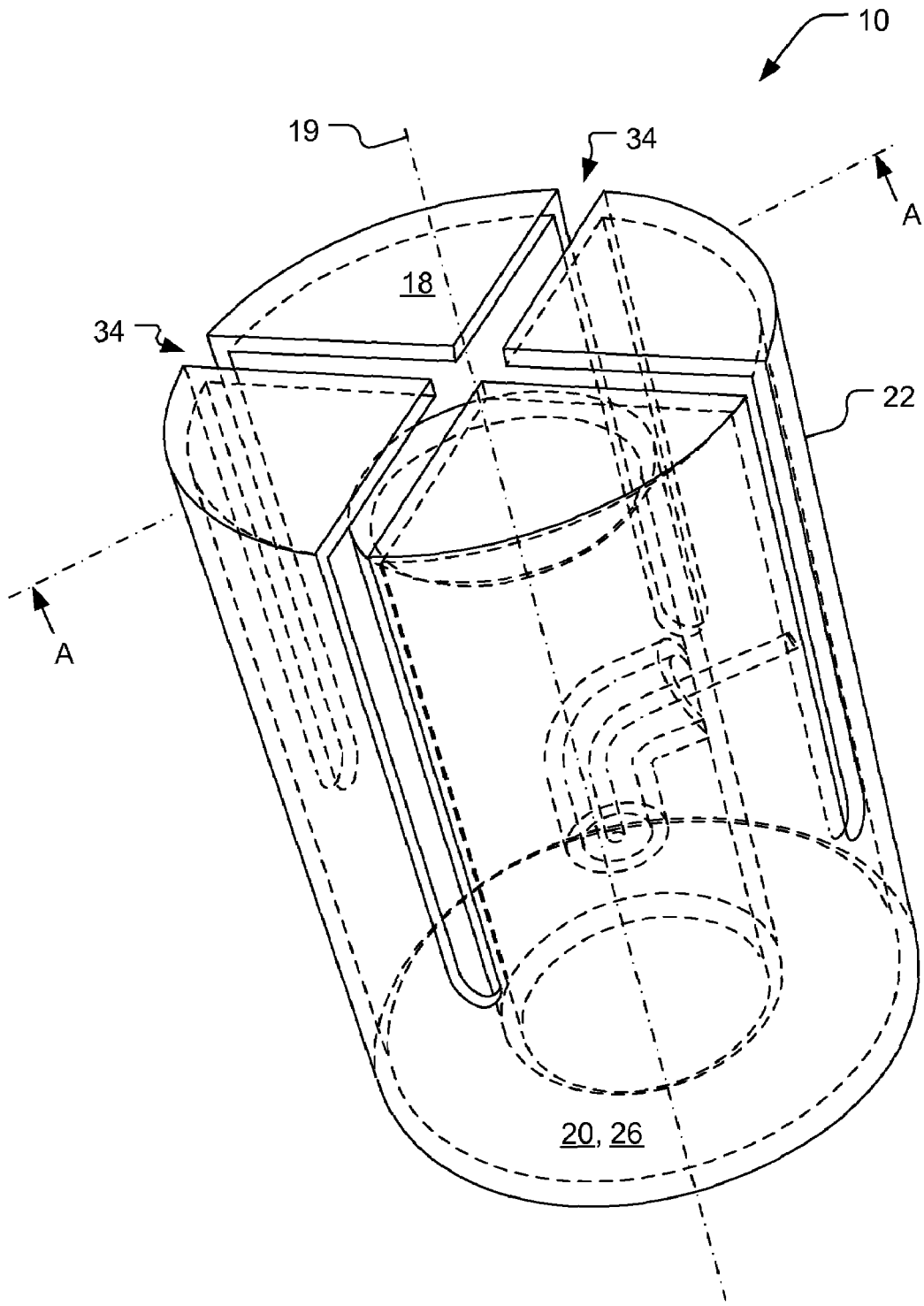
FIG. 1 is a perspective view of a cylindrical embodiment of a slot antenna in accord with the present invention.

A preferred embodiment of the present invention is a slot type antenna. As illustrated in the various drawings herein, and particularly in the view of FIG. 1, preferred embodiments of the invention are depicted by the general reference character 10.

Figure 2:
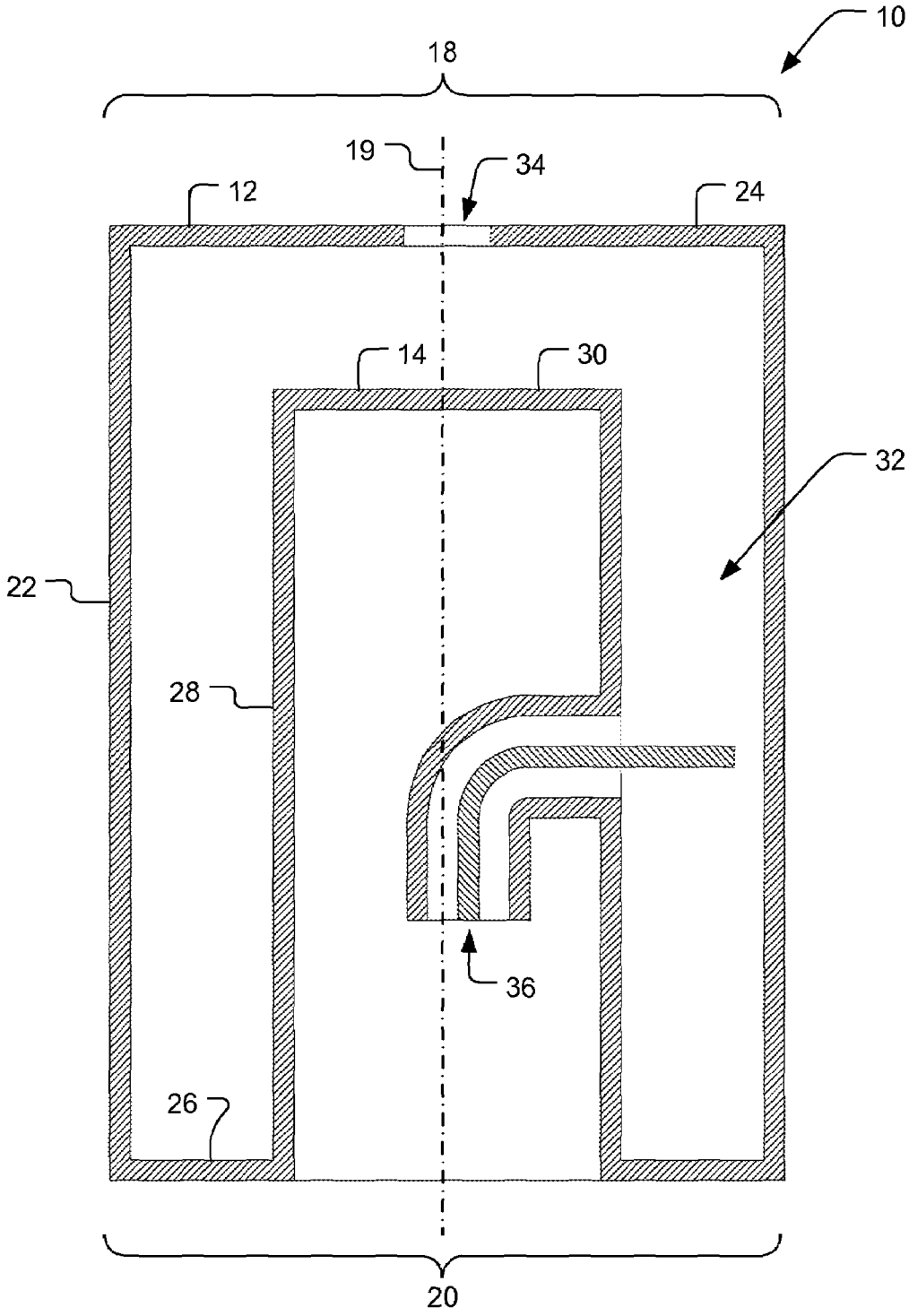
FIG. 2 is a cross-sectional view of the slot antenna in FIG. 1.

FIG. 1 is a perspective view of a slot antenna 10 in accord with the present invention, and FIG. 2 is a cross-sectional view taken along section A-A of FIG. 1. The slot antenna 10 has an outer section 12 and an inner section 14. A top 18, a bottom 20, and a longitudinal axis 19 are also defined as shown. The outer section 12 here includes a cylindrical shaped outer side wall 22, an outer top wall 24, and a bottom wall 26. Similarly, the inner section 14 here includes a cylindrical shaped inner side wall 28 and an inner top wall 30. The outer section 12 and the inner section 14 collectively define an interior region 32. Accordingly, the slot antenna 10 here has a partially coaxial structure and nominally has a cylindrical shape.

The major portions of the outer section 12 and the inner section 14 are made of or have external surfaces that are covered by an electrically conductive material, such as copper. The interior region 32 is filled with a dielectric material, preferably of a low loss type such as air, plastic, or ceramic. [N.b., herein the terms "outer" and "inner" are used with respect to the elements influence on the electrical characteristics of the inventive slot antenna 10, and not necessarily with respect to their literal physical position with respect to inactive other elements. For example, rather than literally be outermost in all embodiments, the outer section 12 may actually be inside a thin layer of nonconductive material, such as foam or plastic, that acts as a protective cover or radome. Similarly, rather than literally be innermost in all embodiments, the inner section 14 need not always be the innermost portion of the overall structure. For instance, to facilitate manufacture the inner section 14 may be deposited onto a more inner base material that provides physical support yet does not substantially alter how the slot antenna 10 performs. Such usage of relative terminology is common in this art and, in any case, should now be clear in view of this reminder.]

In the outer top wall 24 and extending into the outer side wall 22 of the outer section 12, at least one slotted opening 34 is provided. The embodiment shown in FIG. 1 has two such slotted openings 34 in a crossed-slot configuration. Each slotted opening 34 has a length selected so that it resonates at a frequency that is the same as or which is close to the main application frequency or frequencies of the slot antenna 10.

In the inner side wall 28 of the inner section 14, at least one feed 36 is provided. In simplest form, the slot antenna 10 can be fed using a coaxial cable (not shown). The position of the feed 36 can be determined through experiment or electromagnetic simulation. Normally, but not exclusively, a feed 36 is better placed closer to an end of a slotted opening 34. The embodiment shown in FIG. 1 has one coaxial feed 36.

A single feed and a single slotted opening are enough to produce linear polarization. Other structures, such as two substantially similar slotted openings 34 of nearly equal lengths and a single feed 36, can also produce linear polarization. Alternately, other embodiments of the inventive slot antenna 10 can provide other polarizations, as desired. For example, the slot antenna 10 can provide circular polarization if the two substantially orthogonal slotted openings 34 radiate electromagnetic fields with substantially the same amplitude but a 90 degree phase difference.

One prior art approach that is straightforward, but somewhat complex to implement, can also be extended to embodiments of the inventive slot antenna 10. Four coaxial feeds can be symmetrically arranged around the axis of the slot antenna and fed with the same amplitude but progressively phased with 90 degree phase differences between each adjacent feed pair. This approach requires slots with approximately equal lengths and the phase quadrature between the feeds then excites the circular polarization.

Another prior art approach that can be extended to the inventive slot antenna 10 is to use a single feed as shown in FIG. 1 but to differentiate the lengths of the two slots by a specific amount. In this case, the shortest distance between the feed and the two slots needs to be approximately equal. The slightly different slot lengths then cause the slots to resonate at two different frequencies, and the phase of each slot then varies with respect to the actual frequency present. By appropriately tuning the slot lengths a fixed phase offset for each slot is obtained, and a predetermined total phase difference between the two slots can then be provided at a desired specific frequency, i.e., the main application frequency of the slot antenna 10.

Such dual-resonance techniques using the feed system for circular polarization are relatively simple and help make circular polarized embodiments of the slot antenna 10 cheaper to manufacture. Further, when such an embodiment is cylindrical and at least partially coaxial, it has a cardioid radiation pattern with very wide beam coverage and fairly good front-to-back ratio (which is useful for many applications such as GPS). Such an antenna structure also makes it possible to have more optimal tradeoffs between antenna diameter (horizontal extent) and antenna profile (vertical extent) for specific applications. This can create circular polarization over a very large angular region (e.g., about +/−50 degrees in both planes).

As is known in the art, double resonance methods of creating circular polarization generally produce relatively narrow bandwidths. In contrast, the inventive slot antenna 10 can be designed to have a fairly low VSWR over a wider bandwidth. Thus it can have a mixed linear polarization in frequencies other than the circular polarization narrow bandwidth, and it therefore can be used for specialized applications, e.g., mobile applications, which need both circular polarization and mixed linear polarization albeit in different portions of their total bandwidths.

Many other known prior art techniques can also be applied to further improve the inventive slot antenna 10. For example, other shapes can be utilized for the slotted openings 34. This can provide various benefits, with increased bandwidth and reduced size being two common ones.

Figure 3A:
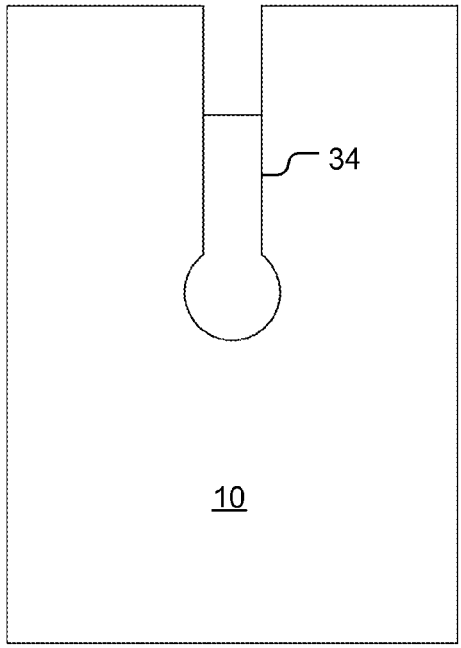
FIGS. 3*a-d* are side views of exemplary slot antennas having different slotted opening characteristics.
Figure 3B:
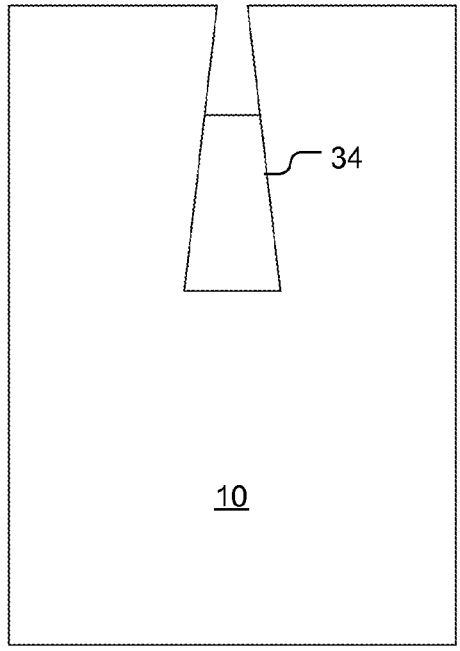
Figure 3C:
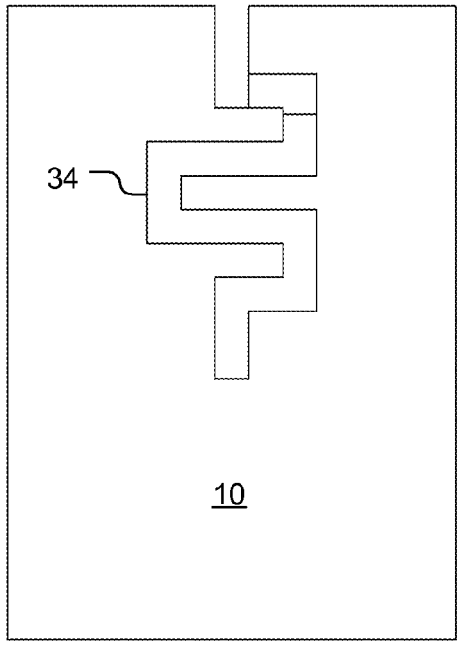
Figure 3D:
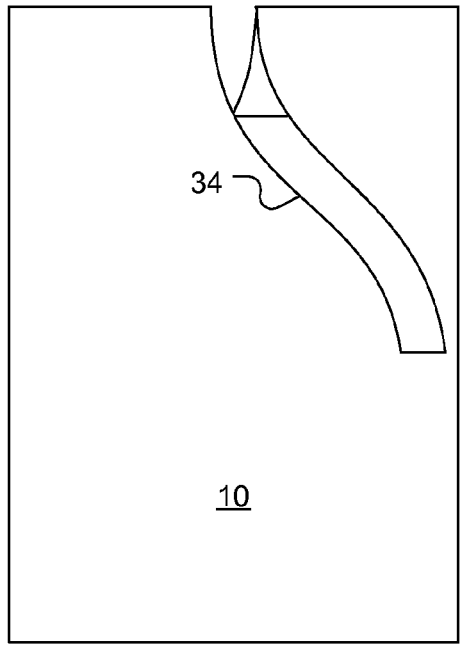

FIGS. 3*a-d* are side views of examples of slot antennas 10 having different characteristics in the slotted openings 34. FIG. 3*a* shows a dumbbell-shaped slotted opening 34, FIG. 3*b* shows a taper-shaped slotted opening 34, FIG. 3*c* shows meandered slotted opening 34, and FIG. 3*d* shows a spiral-shaped and diagonally extending slotted opening 34. [N.b., the example here is nominally spiral-shaped, but that is not a requirement. A slotted opening 34 could have a different curvature or even extend linearly and diagonally in the outer side wall 22.] Although the examples in FIGS. 3*a-d* have single slotted openings 34, it also should be noted that embodiments of this invention may have any number of slotted openings 34, with these and other possible shapes.

Another prior art technique that can be extended to the inventive slot antenna 10 is to load the slot antenna 10 with low loss plastic or ceramic material with high dielectric constant to improve the mechanical stability and/or reduce the size of such a slot antenna 10 compared to that of a slot antenna 10 with air as the dielectric. Adding extra impedance matching networks can also be used to reduce the antenna VSWR over a wider bandwidth.

When embodiments of the slot antenna 10 are dielectric loaded, they can be made by conventional photoetching techniques. This is particularly useful for a fully dielectric loaded slot antenna 10 (versus a partially loaded embodiment). For example, first the interior region 32 of a dielectric material is provided. Then a metallization procedure is used to coat the surfaces of this with what will ultimately become the outer section 12 and the inner section 14 of the slot antenna 10. Next portions of the metallized surfaces are partially removed in a predetermined pattern to produce the final outer section 12 and inner section 14, particularly including one or more slotted openings 34. Alternatively it is also possible to make a mask which contains a negative of the required pattern, and to then deposit metallic material on the surfaces of the interior region 32, using the mask to partially cover these so the metallic material is applied according to the desired pattern.

Yet another prior art technique that can extend the inventive slot antenna 10 is to provide a choke. For instance, a quarter wavelength coaxial sleeve type choke or a short circuited radial transmission form of choke can be provided to isolate the slot antenna 10 from a platform to which it is physically connected, thus reducing undesired coupling effects.

Returning now to FIG. 1, this depicts an embodiment of the inventive slot antenna 10 that facilitates discussion of some design considerations. Suppose that one wants to design a linear polarization slot antenna 10 utilizing a configuration similar to that shown. A first step then can be to assume two slotted openings 34 having equal length and having the respective shortest distances to the coaxial feed 36 being substantially equal. The next step is to select some initial dimensions based on the desired frequency and the dielectric material being used. Such dimensions can include the separation between the outer section 12 and the inner section 14 at the upper part of the interior region 32, the external and internal radii of the outer section 12 and the inner section 14, and the thickness of the conductive outer side wall 22 and the inner side wall 28. One can determine (experimentally or through simulation) other parameters to have a reasonable return loss in the desired bandwidth. Such parameters include the lengths of the slotted openings 34 (which here are equal), the total height of the interior region 32, the height of the inner side wall 28, and the vertical position of the coaxial feed 36. Since the two slotted openings 34 will radiate equally with the same phase, the slot antenna 20 thus designed should simply be linear polarized.

Once one has such a linearly polarized design, it can be changed to provide circular polarization over a narrow band. To do this all of the selected and designed dimensions can be kept except for the lengths of the slotted openings 34. One slotted opening 34 now needs to be shorter and the other slotted opening 34 now needs to be longer, and once these lengths are determined the design is finished. If the two slotted openings 34 are not orthogonal it is still possible to have a linearly polarized slot antenna 10, but then changing the design to get circular polarization becomes more difficult.

Still other known prior art techniques can be applied to further extent the capabilities the inventive slot antenna 10.

Figure 4:
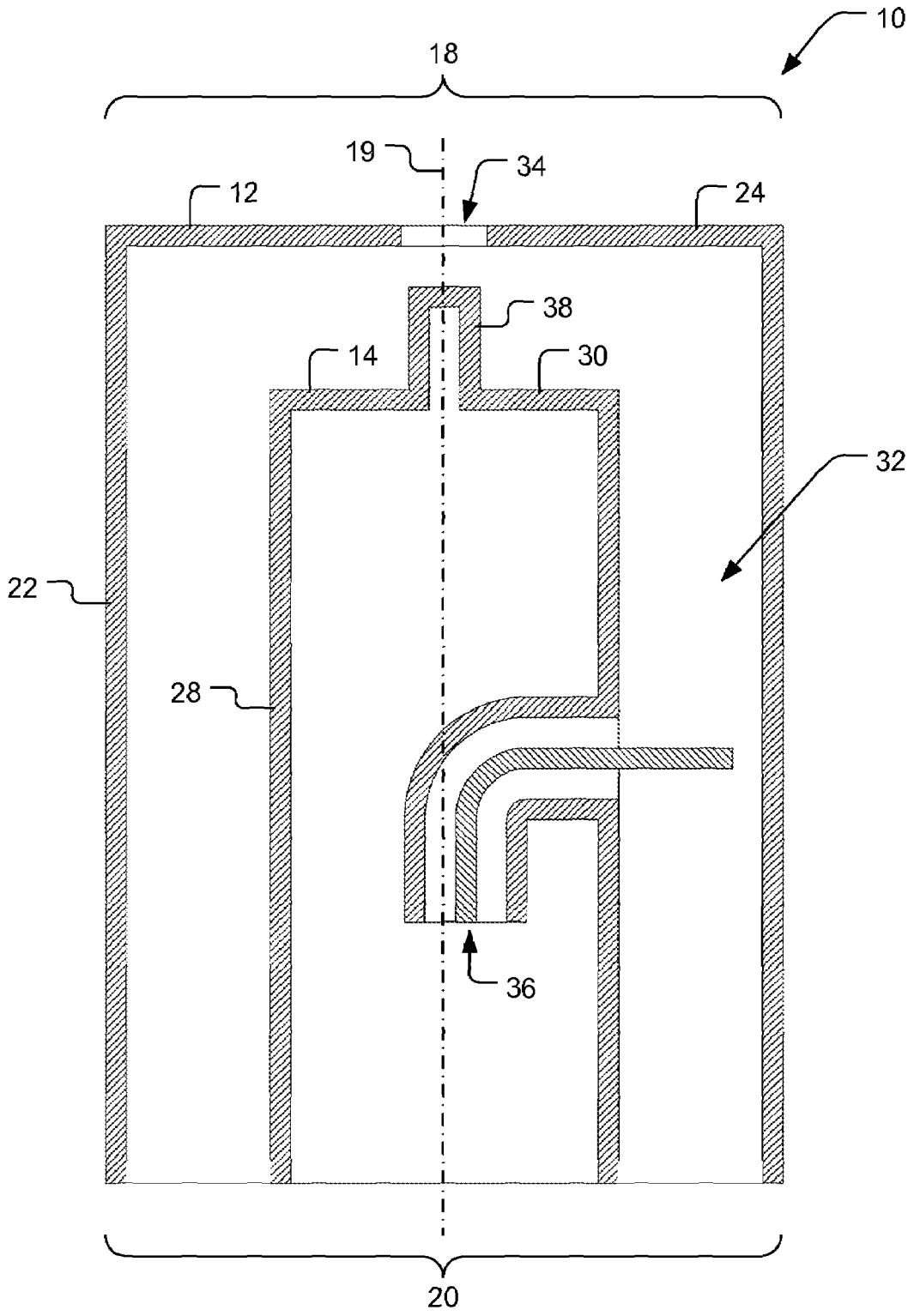
FIG. 4 is a cut away view of an alternate cylindrical-shaped slot antenna that is also in accord with the present invention.

FIG. 4 is a cut away view (in principle, equivalent to the cross-sectional view taken along section A-A of FIG. 1) of an alternate cylindrical-shaped slot antenna 10 that is also in accord with the present invention. As can be appreciated, the inner top wall 30 here is not simply flat. Rather, it includes a cylindrical stub 38. It is known in the art to use matching and suppressing stubs, and the point to be taken here is that the flat or somewhat curved inner top wall 30 of the inventive slot antenna 10 may optionally include various shapes, such as the stub 38 shown here.

FIG. 4 also illustrates another possible distinction from the embodiment shown in FIG. 1 and FIG. 2. The bottom wall 26 can be optional, and the slot antenna 10 in FIG. 4 does not include this feature.

Figure 5:
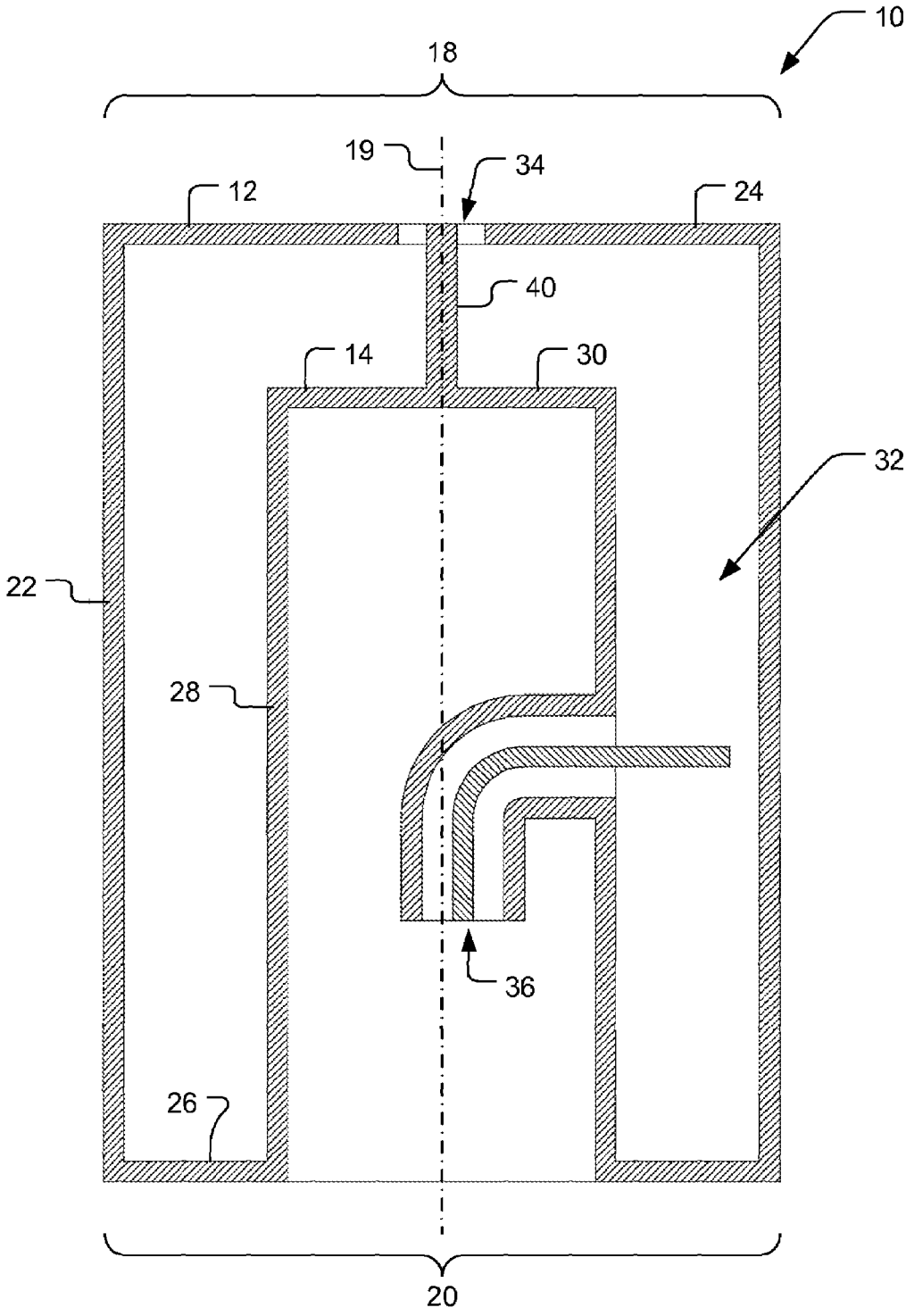
FIG. 5 is a cut away view of another alternate cylindrical-shaped slot antenna that is also in accord with the present invention.

FIG. 5 is a cut away view of another alternate cylindrical-shaped slot antenna 10 that is also in accord with the present invention. A small cylindrical stub 40 is provided here, albeit one that is thinner than the stub 38 in FIG. 4 and that extends all the way to the top 18 of the slot antenna 10. Again, such a feature can be of various shapes and can serve various purposes, for instance, to improve return loss without blocking the radiation from the slotted openings 34.

Figure 6:
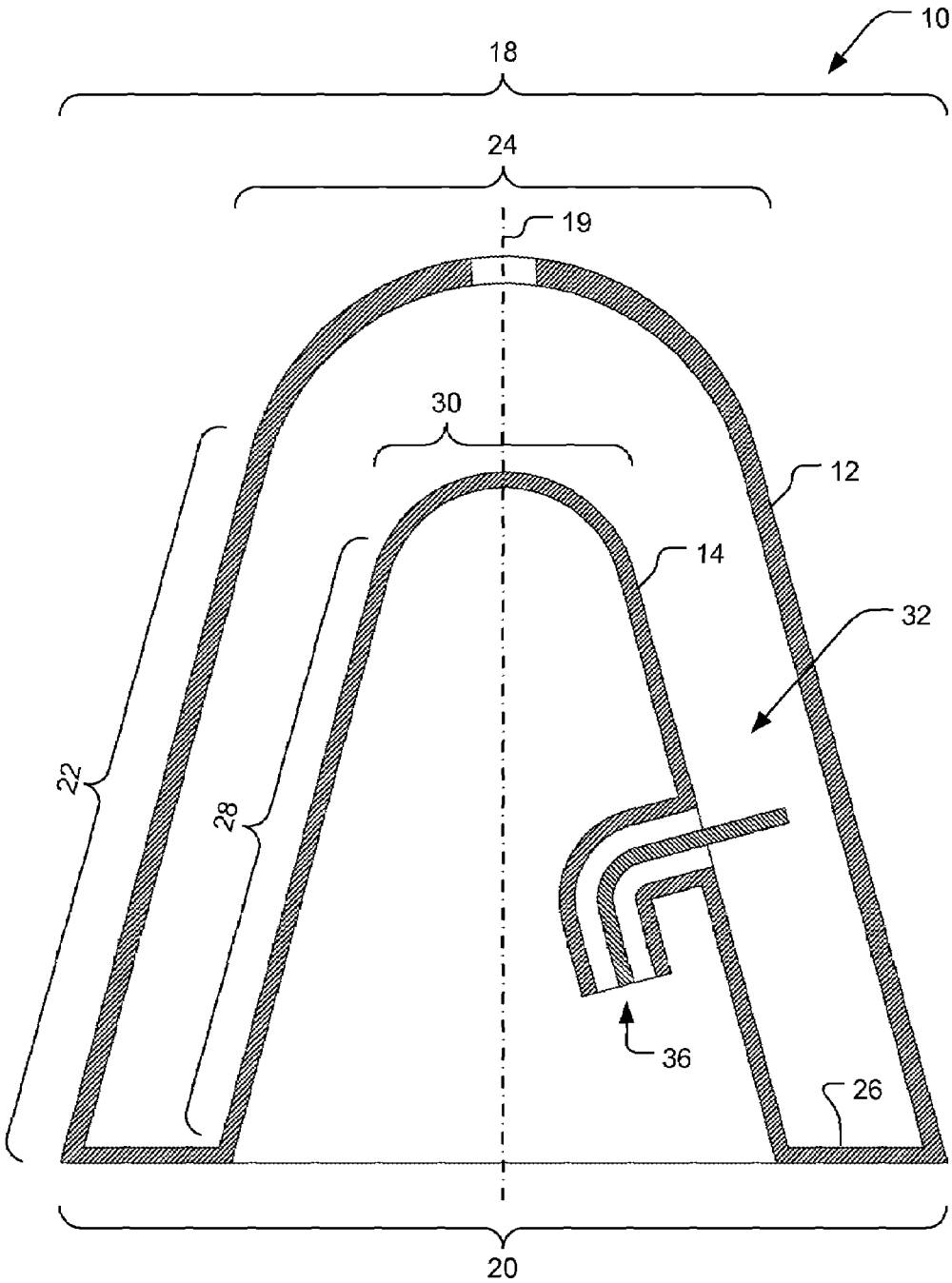
FIG. 6 is a cut away view of a non-cylindrical embodiment of a slot antenna in accord with the present invention.

FIG. 6 is a cut away view of a non-cylindrical embodiment of the slot antenna 10. The partially conical form of the exemplary slot antenna 10 here illustrates that different shapes, other than cylindrical, can also be utilized for the outer section 12 and/or the inner section 14 of the inventive slot antenna 10. The outer side wall 22 here merges into the outer top wall 24, and the inner side wall 28 here merges into the inner top wall 30.

The terms "radiate" and "excite" can be used to refer to the inventive slot antenna 10 for both transmitting and receiving signals. The electrical characteristics of the slot antenna 10, such as its frequency response and radiation pattern, obey the reciprocity rule. Accordingly, if the slot antenna 10 is configured and tuned to radiate right hand circular polarization when excited, it can absorb a right hand circular polarized signal at the same frequency in the receiving mode.

It has been the present inventor's observation that the inventive slot antenna 10 can be manufactured using many well-known fabrication methods. In particular, without limitation, manufacturing here can be easy and result in high product yield and quality, and thus be economical. The slotted openings 34 can, for instance, be formed initially as part the outer section 12, e.g., by casting, or they can be cut or etched in later. Similarly, the feeds 36 can be formed initially as part the inner section 14, or they can be attached later, e.g., by soldering. In many embodiments air can simply be the dielectric material in the interior region 32. In other embodiments, the dielectric material can be introduced to the interior region 32 and allowed to solidify. And to the extent that any such material exits at already existing openings it can be wiped away while still liquid or easily machined off once hardened. In yet other embodiments, a solid-material interior region 32 can be the basis for applying the conductive outer and inner sections 12, 14, e.g., by casting, spraying/sputtering, etc. Then slotted openings 34 can be cut or etched into their final form.

It has also been the present inventor's observation that having the inner section 14 imparts to the slot antenna 10 quite different electrical characteristics than are exhibited by the relevant prior art. For instance, without limitation, embodiments can be made that function efficiently at the frequencies of many important and emerging applications, and that are efficient across the bandwidths needed, and yet that are more suited dimensionally for mobile and handheld applications. In general, embodiments of the slot antenna 10 tend to easily have good signal-to-noise and front-to-back ratios, and to provide wide beam coverage and near-hemispherical radiation patterns approaching omnidirectional. And embodiments of the inventive slot antenna 10 also can be made to fulfill a wide variety of design needs, e.g., to have linear or circular polarization, or even both at different frequencies or beam width portions.

In concert with the observation above about the inner section 14 is another observation that the slot antenna 10 hosts the feed 36 or feeds 36 differently. The slot antenna 10 can employ simple feed systems or complex feed networks, with these entirely out of the outer section 12, if desired, and thus safely away from the top and exterior regions. Yet the slot antenna 10 can also have the feeds 36 flexibly positioned as desired with respect to the slotted openings 34, as long as performance criteria are considered (e.g., providing reasonable impedance matching).

While various embodiments have been described above, it should be understood that they have been presented by way of example only, and that the breadth and scope of the invention should not be limited by any of the above described exemplary embodiments, but should instead be defined only in accordance with the following claims and their equivalents.

What is claimed is:

1. An antenna having defined a top, a bottom, and a central longitudinal axis, the antenna comprising:

an outer section of electrically conductive material which is coaxial with the longitudinal axis, wherein said outer section includes an outer side wall extending from the bottom to join an outer top wall at the top of the antenna;

an inner section of electrically conductive material which is also coaxial with the longitudinal axis, wherein said inner section includes an inner side wall extending from the bottom to join an inner top wall;

said outer section and said inner section defining an interior region there between that is filled with dielectric material;

said outer section having at least one slotted opening with opposed slot ends, wherein each said slotted opening extends from one said opposed slot end in said outer side wall, across said outer top wall, and to another said opposed slot end in said outer side wall; and said inner section including at least one feed to convey electromagnetic energy into or out of said interior region of the antenna.

2. The antenna of claim 1, wherein:

said outer section has cylindrical shape such that outer side wall is curved circumferentially around the longitudinal axis and said outer top wall is nominally orthogonally disposed about the longitudinal axis; and said inner section also has cylindrical shape such that inner side wall is also curved circumferentially around the longitudinal axis and said inner top wall is also nominally orthogonally disposed about the longitudinal axis.

3. The antenna of claim 2, wherein:

at least one of said outer top wall and said inner top wall is flat.

4. The antenna of claim 2, wherein:

portions of at least one said slotted opening extend parallel with the longitudinal axis in said outer side wall.

5. The antenna of claim 1, wherein:

portions of at least one said slotted opening extend coplanar with the longitudinal axis in said outer side wall.

6. The antenna of claim 1, wherein:

portions of at least one said slotted opening extend linearly and non-coplanar with the longitudinal axis in said outer side wall.

7. The antenna of claim 1, wherein:

portions of at least one said slotted opening extend non-linearly and non-coplanar with the longitudinal axis in said outer side wall.

8. The antenna of claim 7, wherein:

portions of at least one said slotted opening in said outer side wall meander.

9. The antenna of claim 1, wherein:

said slotted openings are defined to have widths; and portions of at least one said slotted opening has differing said widths in said outer side wall.

10. The antenna of claim 1, wherein:

said outer section has at least two said slotted openings that cross at the longitudinal axis.

11. The antenna of claim 10, wherein:

at least two said slotted openings have different length.

12. The antenna of claim 10, wherein:

said plurality of at least two said slotted openings are equally radially disposed with respect to the longitudinal axis.

13. The antenna of claim 1, wherein:

said outer section further includes a bottom wall of electrically conductive material, wherein said bottom wall closes said interior region at the bottom of the antenna.

14. The antenna of claim 1, wherein:

said inner top wall includes at least one stub.

* * * * *